US008783839B2

(12) United States Patent
Deshiikan et al.

(10) Patent No.: US 8,783,839 B2
(45) Date of Patent: Jul. 22, 2014

(54) SYSTEM AND METHOD FOR MELTING SOLID-INK PELLETS

(75) Inventors: Srinivasa R. Deshiikan, Wilsonville, OR (US); John B. Mulley, Portland, OR (US); Julie Mulley, legal representative, Portland, OR (US)

(73) Assignee: Xerox Corp., Norwalk, CT (US)

( * ) Notice: Subject to any disclaimer, the term of this patent is extended or adjusted under 35 U.S.C. 154(b) by 296 days.

(21) Appl. No.: 13/316,560

(22) Filed: Dec. 12, 2011
(Under 37 CFR 1.47)

(65) Prior Publication Data

US 2013/0145943 A1 Jun. 13, 2013

(51) Int. Cl.
*B41J 2/175* (2006.01)

(52) U.S. Cl.
CPC ..... *B41J 2/17593* (2013.01)
USPC ..... 347/88

(58) Field of Classification Search
CPC ..... B41J 2/17593
USPC ..... 347/88
See application file for complete search history.

(56) References Cited

U.S. PATENT DOCUMENTS

| | | | | |
|---|---|---|---|---|
| 4,580,147 | A * | 4/1986 | DeYoung et al. | 347/88 |
| 8,240,830 | B2 * | 8/2012 | Jones et al. | 347/88 |
| 2005/0007428 | A1 * | 1/2005 | Joppen | 347/88 |
| 2009/0185016 | A1 * | 7/2009 | Jones | 347/88 |
| 2011/0221837 | A1 * | 9/2011 | Jones et al. | 347/88 |

* cited by examiner

*Primary Examiner* — Stephen Meier
*Assistant Examiner* — Alexander D Shenderov
(74) *Attorney, Agent, or Firm* — Joseph E. Root

(57) ABSTRACT

An apparatus and method disclosed for delivering solid-ink pellets in an image-forming device comprises a hopper that houses solid-ink pellets. The hopper defines a vent and is provided with a mechanism to regulate the passage of the solid-ink pellets through the vent. A restrainer member configured to receive the solid-ink pellets defines a restrainer surface and a spreading arrangement to evenly spread the solid-ink pellets on its surface. Positioned below the vent, the restrainer retains the solid-ink pellets and is configured to transmit heat to solid-ink pellets causing them to melt evenly.

7 Claims, 3 Drawing Sheets

SYSTEM AND METHOD FOR MELTING SOLID-INK PELLETS

TECHNICAL FIELD

The presently disclosed embodiments relate to delivery of solid-ink pellets to an image forming apparatus, and more particularly to devices that efficiently extract solid-ink pellets and enable uniform melting.

BACKGROUND

In recent years, imaging devices, such as printers and copiers, have begun employing solid ink, provided in the form of ink sticks or solid-ink pellets. In solid-ink devices, solid-ink pellets are stored in a hopper, from where they are extracted and fed to the imaging device. A heater, such as a grate heater melts the pellets, and the liquid ink then flows through the grate openings into an ink reservoir. The reservoir further distributes ink to print heads during image formation.

It may happen, however, that solid-ink pellets are not uniformly or consistently extracted from the hopper, leading to inconsistent solid-ink pellet delivery and resultant inconsistent image formation. Flow problems can produce heaps of solid-ink pellets on the grate heater, for example, creating lumps, which melt irregularly. Melting problems lead to inconsistent ink flow, which in turn affects image formation.

Therefore, extraction of solid-ink pellets needs to be maintained and carried out uniformly and melt all the extracted pellets with a consistent rate for optimum results.

In current practice, no solution exists that uniformly extracts pellets and melts them efficiently. It's therefore desirable to have a small and a cost effective solution for the delivery of ink in an image forming apparatus that operates in a controlled manner.

SUMMARY

One embodiment of the present disclosure provides an apparatus for delivering solid-ink pellets in an image-forming device. The apparatus comprises a hopper for retaining and dispensing solid-ink pellets. The hopper defines a vent and incorporates a mechanism to regulate the dispensing passage of the solid-ink pellets. A restrainer member disposed below the vent to receive the dispensed solid-ink pellets defines a restrainer surface that substantially slopes away from the vent. The restrainer surface is configured to spread solid-ink pellets evenly on the restrainer surface and transmit heat energy, causing the solid-ink pellets to substantially melt.

Certain embodiments disclose a system for delivering solid-ink pellets in an ink delivery mechanism of an image forming apparatus. The system includes a hopper for retaining solid-ink pellets, the hopper having inwardly sloped sides, defines a vent between their closest edges, enabling a passage for the solid-ink pellets. A rotary vane is disposed in the vent and includes a spindle comprised of multiple vanes, spaced such that they are sized to accept the solid-ink pellets. Disposed beneath the hopper vent is a roll restrainer, having a first surface and a second surface, the first surface including spreading members, and the second surface heated to a temperature sufficient to melt the solid-ink pellets disposed on the first surface.

Another embodiment discloses a method for delivering solid-ink pellets in an image forming device. The method includes transferring solid-ink pellets from a hopper to a roll restrainer via a rotary vane. Evenly distributing the solid-ink pellets on the roll restrainer is consequently performed. Such an even distribution is enabled through spreading members incorporated with the roll restrainer. A heater coupled to the roll restrainer assists in melting the solid-ink pellets, and the liquidized ink is thereby transferred to an ink reservoir.

Other embodiment discloses an apparatus for restraining the rolling action of solid-ink pellets on a heater in an image forming device. The restraining measures may be spikes, channels, grooves, projections, etc, that inhibit the solid-ink pellets from rolling off the edges of the heater.

DETAILED DESCRIPTION

The following detailed description is made with reference to the figures. Preferred embodiments are described to illustrate the disclosure, not to limit its scope, which is defined by the claims. Those ordinarily skilled in the art will recognize a number of equivalent variations in the description that follows.

Overview

In this solid-ink delivery system of an image-forming device, solid-ink pellets are stored in a hopper. The hopper includes a vent at the bottom forming an exit passage for the solid-ink pellets. The vent is oriented generally perpendicular to the direction of travel of the solid-ink pellets. A rotary vane positioned at the vent, feeds solid-ink pellets from the hopper in a controlled fashion. Upon exiting, the solid-ink pellets fall onto a spreader baffle and then to a roll restrainer. The latter element is a generally flat plate that performs two functions. First, it includes a spreading structure that promotes an even distribution of pellets across the roll restrainer. Secondly, the roll restrainer is coupled to a heater that transmits sufficient heat to melt the solid-ink pellets. In addition, the channeled surface avoids a pellet pile up on the roll restrainer. The melted solid-ink flows from the roll restrainer and collects in an ink reservoir, from where the melted ink is distributed to the proceeds to the image forming station print head.

Exemplary Embodiments

Figure 1:
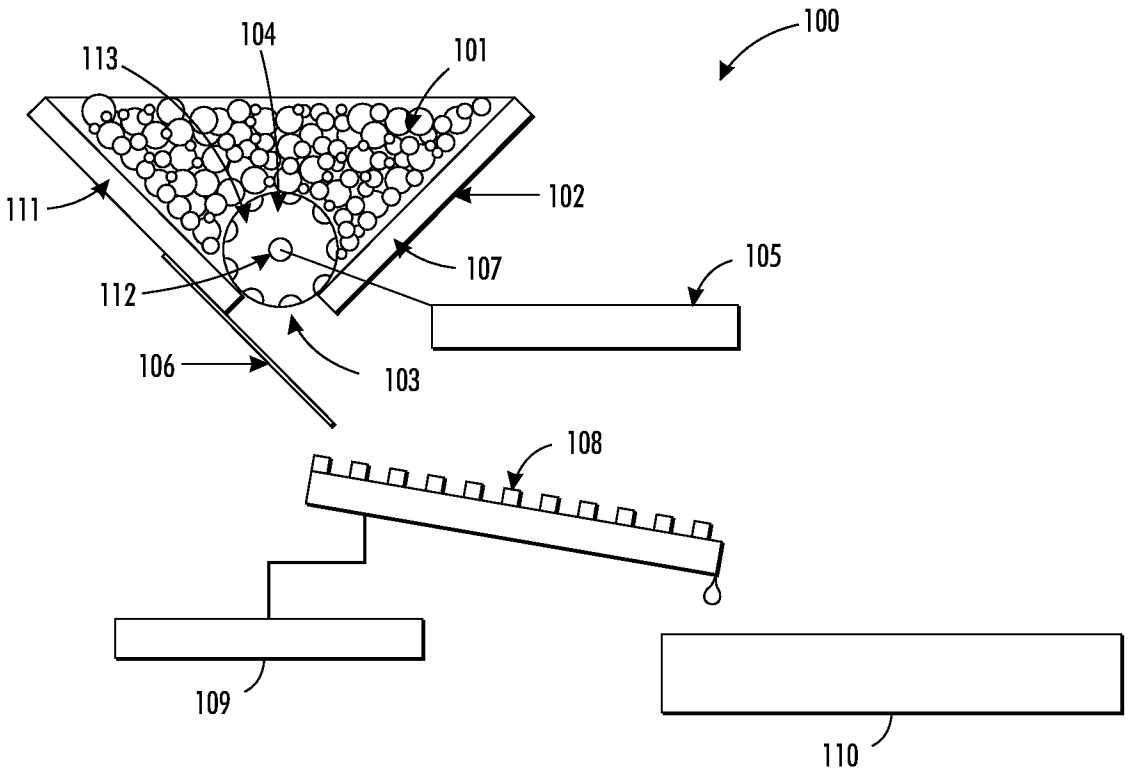
FIG. 1 illustrates an exemplary system for evenly distributing solid-ink pellets on a heating surface according to the present disclosure.

FIG. 1 illustrates an exemplary solid-ink delivery system 100, according to the embodiments of the present disclosure. The delivery system includes a hopper 102, a restraining member such as a roll restrainer 108, and a transfer assembly comprising a rotary vane 104, a spreader baffle 106, and an ink reservoir 110.

The hopper 102 is a sloped-sided device extending transversely across the direction of travel of the solid-ink pellets, which stores, retains, and dispenses solid-ink pellets 101. It includes sides 107 and 111, a vent 103 between the lower ends of the sides 107 and 111, and a rotary vane 104 disposed in the vent 103. Sides 107 and 111 slope downward and inward, assuming a V-shape in the illustrated embodiment. The hopper 102 can be formed of any suitable heat resistant material that withstands elevated temperatures associated with the solid-ink pellet melting process described below. Hopper 102 can be formed in a variety of shapes, but the V shape is well suited to promoting gravity flow of a particulate material. Importantly, the hopper 102 may include audio or visual depletion indicators, indicating that the hopper 102 has run out of the minimum quantity of the solid-ink pellets 101 required for the imaging process.

In another embodiment, the hopper 102 may have a "U-shaped" configuration in order to increase the amount of solid-ink pellets 101 that could be stored at a particular period. Alternatively, the hopper 102 may be customized according to the shape, design, and size of the imaging machine. A hopper shaped in a customized manner may provide for easy concealment, packaging, assembly, and disassembly in the printing machine, improving applicability during repair and servicing. In all embodiments, the hopper 102 is configured to maximize the quantity of solid-ink pellets 101 stored at a particular period. Accordingly, the hopper 102 is shaped and designed to be free from any obstructions, restrictive corners, barriers, etc., that would restrict the flow of the solid-ink pellets 101.

The stored solid-ink pellets 101 may be constantly replaced with newer solid-ink pellets from the top of the hopper 102 as and when the solid-ink pellets 101 is depleted. A lid or a cover being optionally provided assists in the addition of solid-ink pellets 101. The top lid of this hopper 102 can also include a feeding port or an inlet from where the solid-ink pellets 101 can be fed into the system. A depletion indicator may be fitted outside the hopper 102 or outside the image forming apparatus.

The lower edges of the sides 107 and 111 define a vent 103 and are designed to provide an exit passage to the solid-ink pellets 101. Vent 103, at the bottom of the hopper 102, is linearly structured and is therefore conformed to house a similarly configured transfer assembly. The rotary vane 104, as part of the mechanism for regulating passage, feeds solid-ink pellets 101 from the hopper 102 through the vent 103 in a controlled manner to the underlying roll restrainer 108. As the name suggests, the rotary vane 104 consists of a spindle 112, carrying a set of vanes 113 that engage the solid-ink pellets 101 and impel them through the vent 103.

Rotary vane 104 can be positioned in the vent 103, sized so that the vanes 113 engage the lower edges of sides 107 and 111, preventing any flow of solid-ink pellets past the rotary vane 104.

Thus, the flow of solid-ink pellets 101 is completely controlled by the rotary vane 104. A primary factor in determining that flow is the number and depth of vanes 113.

Further, the shape and size of the vanes 113 of the rotary vane 104 may be sized to accept the solid-ink pellets 101. The shape and size of the rotary vane 104 could also be in accordance with the size of the bottom vent 103. Sizing of the rotary vane 104 in accordance with the vent 103 is critical to restrict an inadvertent escape of the solid-ink pellets 101 from the hopper 102 via the vent 103. The rotary vane 104 is therefore appropriately sized to fit the confines of the vent 103 to maintain a steady flow of solid-ink pellets 101, only upon rotation. To readily transfer the solid-ink pellets 101 from the hopper 102 to the roll restrainer 108, at least a portion of the rotary vane 104 is maintained in constant contact with the solid-ink pellets 101 at all times. While in rotation, this positioning of the rotary vane 104 allows gravity to act upon the solid-ink pellets 101 and engage them in the vanes 113, eventually transferring them onto the next station, i.e., the roll restrainer 108.

The vanes 113 of the rotary vane 104 may have a straight or a linear profile, encompassing and transferring a row of solid-ink pellets 101 every time. Such a conformation enables a fixed volume transfer of the solid-ink pellets 101 on every subsequent rotation of the rotary vane 104.

Alternatively, the rotary vane 104 may also have vanes 113 that have a toroidal or a helical profile. A toroidal rotary profile can provide a flow path to the solid-ink pellets 101 which is in line with the axis of the rotary vane 104. This flow path can help maintain a linear flow of the solid-ink pellets 101. Importantly, a toroidal profile may also enable the exit passage or the vent 103 for the solid-ink pellets 101 to be positioned on either side of the hopper 102 rather than being placed at the bottom. This configuration can be applied to printers with different platforms, space and operation requirements.

The rotary vane 104 can be made of any rigid material, since its operation includes engagement of the solid-ink pellets 101 and their transfer. Importantly, the materials used in the manufacture of the rotary vane 104 must be chemically and environmentally stable and least reactive to the solid-ink's compositions. Materials can be, but not limited to, stainless steel, high grade plastic, and so on.

It will be understood that any other rotary device, similar to the rotary vane 104 as described, incorporating vanes, fins or any similar protrusions can be employed in the transfer of the solid-ink pellets 101 from the hopper 102. These devices are widely known to those of skill in the art such as the rotary arrangements employed in water pumps, etc.

The electric motor 105 coupled to the rotary vane 104 drives the rotary vane 104 in a controlled manner. Those in the art will understand the specifications required for such a motor and will be aware of the many choices available to the market. Choices include devices such as a stepper motor, which can optionally be provided with a rotation controller, a sensor, a timer, etc., depending upon the input requirements. The input requirements can vary from the number of pages being printed at a time to the amount of color or contrast required for particular prints.

Moreover, the electric motor 105 can be automatically controlled, independent of any manual intervention. This operation would depend upon key factor inputs such as the color or the number of prints required. Any suitable electric motor, such as a synchronous motor, an induction motor, or a stepper motor may be used without departing from the scope of the present disclosure. Moreover, the electric motor 105 may generate sufficient power to efficiently drive the rotary vane 104 and at the same time, not to generate excessive power to create a substantial carbon footprint.

To uniformly distribute the solid-ink pellets 101 and to avoid an eventual pile up on the roll restrainer 108, the system employs a spreader baffle 106 slantingly disposed between the vent 103 and the roll restrainer 108. Spreader baffle 106 directs the solid-ink pellets 101 from the hopper 102 to the roll restrainer 108 by being positioned in an inclined manner in relation to the entire system. Uniform distribution of the solid-ink pellets 101 is achieved through the action of gravity when the solid-ink pellets 101, falling from the vent 103, fill the grooves, apertures, or channels 202 built into the spreader baffle 106, while sliding down the to the roll restrainer 108. Channels 202 are 5 to 10 times larger in width to the largest pellet size of 1.2 mm, making it 6 to 12 mm wide in order to prevent the flow of the solid-ink pellets 101 from clogging. Heaps of solid-ink pellets 101 are consequently avoided as the channels 202 spread out the solid-ink pellets 101 in an efficient manner, leading to an evenly distributed solid-ink pellet surface on the roll restrainer 108. This operation improves the surface contact area between the solid-ink pellets 101 and the surface of the roll restrainer 108, consequently melting the solid-ink pellets 101 rapidly and more uniformly.

As shown in the figures, the spreader baffle 106 may be a rectangular plate, comprising two edges, with the first edge fixedly connected to the sloped side 111 of the hopper 102, and the second edge suspended above the roll restrainer 108, without touching it. The spreader baffle 106, therefore, provides a path to the solid-ink pellets 101 falling from the hopper vent 103 to the roll restrainer 108.

The spreader baffle 106 is structured to cover the entire width of the hopper vent 103 such that the amount of solid-ink pellets 101 exiting the vent 103 at any stage may fall directly on the spreader baffle 106, and not outside. Correspondingly, the spreader baffle 106 may also be sized in width according to the roll restrainer 108, such that solid-ink pellets 101 falling on its surface spread evenly on the surface of the roll restrainer 108.

Alternatively, the spreader baffle 106 may include an agitating mechanism or an angular displacement mechanism. These mechanisms agitate the structure to evenly spread the solid-ink pellets 101, or rotate the baffle around a pivot point to displace the end of the baffle close to the roll restrainer 108 allowing it to disperse the solid-ink pellets 101 over the length of the roll restrainer 108.

Figure 2:
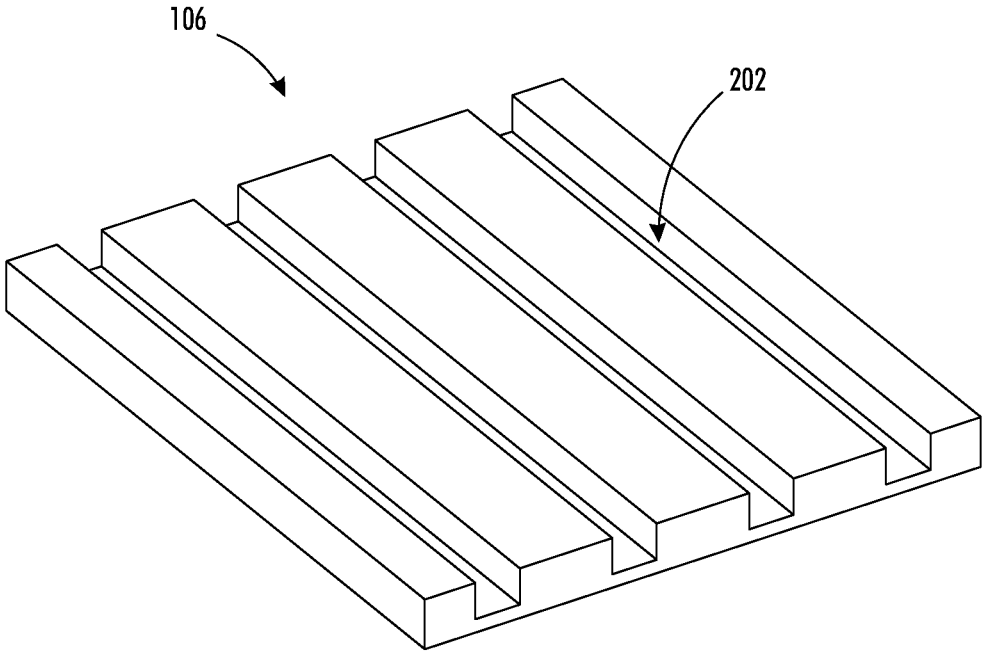
FIG. 2 illustrates an exemplary spreader baffle device with apertures, grooves, or channels.

Because the solid-ink pellets 101 can only exit the spreader baffle 106 through the employed grooves, apertures, or channels 202, the underlying restrainer 108 receives solid-ink pellets 101 in a uniform fashion. It is understood that the pattern, number and size of apertures or channels 202 may change depending on the printer models, volume of solid-ink pellets 101, pellet size, number of prints required, etc. FIG. 2 is a perspective view of one such baffle with equidistant apertures or channels 202 to guide the solid-ink pellets 101 from the vent 103 to the roll restrainer 108.

Alternatively, the spreader baffle 106 may be movable. The solid-ink pellets 101, while transferring, may pass through the moveable spreader baffle 106, creating a mechanism to evenly distribute the solid-ink pellets 101 onto the roll restrainer 108. For example, the spreader baffle 106 may be pivotable on a fulcrum point close to the rotary vane 104. Agitation of the spreader around the fulcrum directionally spreads the solid-ink pellets 101 falling onto the roll restrainer 108. This system, as stated, would require additional electrically operated mechanisms equipped with measures that assist in the pivotal movements. Similarly, the spreader baffle 106 may be laterally agitated to spread the solid-ink pellets 101 falling on the roll restrainer 108. It is understood that any other movement similarly operating mechanisms may be employed to evenly spread the solid-ink pellets 101.

In another embodiment, a sieve or a strainer type device that achieves uniform distribution of the solid-ink pellets 101 can replace the spreader baffle 106. This device can be hung, suspended above, or placed directly on the roll restrainer 108 in a horizontal manner, unlike earlier suggested placements. When the solid-ink pellets 101 drop onto the sieve from the hopper 102, they are distributed on the roll restrainer 108 evenly through the sieve.

Figure 3:
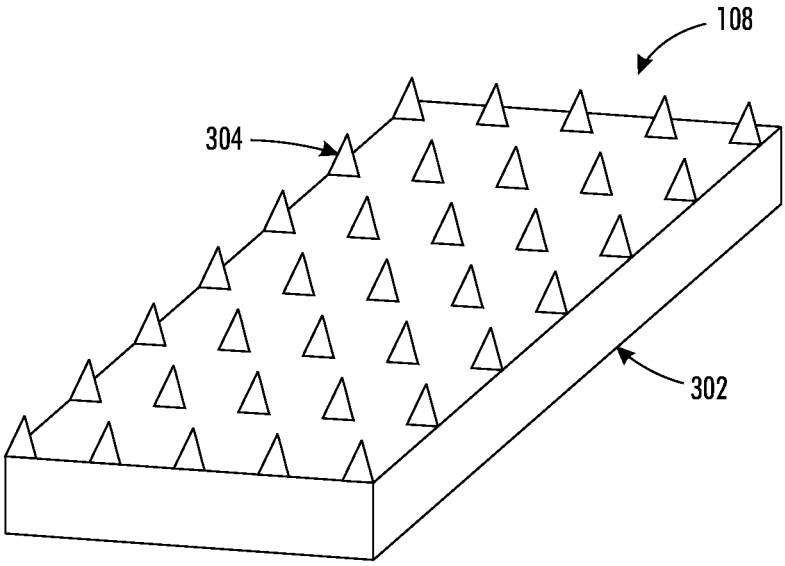
FIG. 3 illustrates an exemplary roll restraining device with multiple projections.

FIG. 3 illustrates the roll restrainer 108 designed to include a first surface comprised of a spreading arrangement incorporated with equidistant spreading members, such as spikes or projections 304 to restrain the solid-ink pellets 101 from rolling off its edges. A second surface of the roll restrainer 108 may include base plate surface 302 coupled to an electric heater 109, enabling heat transmission and melting operation to be performed on the first surface. Alternatively, the roll restrainer 108 may also be designed to include measures similar to the projections 304 or any form of channels, grooves that enable effective restraint to the movement of the solid-ink pellets 101 caused especially during transfer. Importantly, the gaps between the projections 304 included in the roll restrainer 108 may be configured to accommodate the largest pellet size of 1.2 mm. The permissible range for the amount of solid-ink pellets 101 passed to the roll restrainer 108 over a period in the system may be determined by the overall restrainer surface area, heat density, and may vary with the melt rate requirements.

The roll restrainer 108 may occupy a position below the hopper 102 and below the spreader baffle 106. Because the roll restrainer 108 is constantly heated, it may be appropriately positioned away from the hopper vent 103, so that the heat from the roll restrainer 108 does not reach the vent 103 and melt the solid-ink pellets 101 or affect them in any manner while they are stored in the hopper 102. Moreover, such positioning cannot be avoided since the solid-ink pellets 101 employed in the process may be made from a liquefiable or wax-based substance that have low meting points, possessing static charge and may consequently exhibit conglomerations. A small fan may be positioned underneath the spreader baffle 106 directing room air to gently flow across the roll restrainer 108 and thus take away the heated air from the roll restrainer 108 eliminating or significantly mitigating the heat effects.

The rectangular shaped surface of the roll restrainer 108 is positioned to substantially slope away from the vent 103. Upon reception of the solid-ink pellets 101 through the spreader baffle 106, the roll restrainer 108 functions to retain the solid-ink pellets 101 from falling off the restrainer edges through the incorporation of multiple spikes, channels, grooves, or projections 304 on its surface. Alternatively, the roll restrainer 108 may include boundary walls to restrict the solid-ink pellets 101 from falling off the edges. Restrictive measures in the form of spiked protrusions or projections 304 employed on the roll restrainer 108 may be configured to accommodate the largest solid-ink pellet 101.

The total melting time for the solid-ink pellets 101, being less than a few seconds, is dependent on two factors. Firstly, the available surface area on the roll restrainer 108 reserved for the solid-ink pellet contact and secondly, the heating capacity or the heat flux, of the surface of the roll restrainer 108.

As an option, the heating rate of the roll restrainer 108 to melt the solid-ink pellets 101 could be made to vary according to the speed of rotation of the rotary vane 104.

In an alternate embodiment, the spreader baffle 106 may be removed from the system, and the roll restrainer 108 may be made movable to uniformly distribute the solid-ink pellets 101. While transferring solid-ink pellets 101, the roll restrainer 108 may be adapted to move or translate horizontally in a to-and-fro manner and help in the uniform distribution of the solid-ink pellets 101. This system of to and fro motion, while avoiding a spreader baffle 106, would require additional electrically operated motors or mechanisms equipped with measures that assist in the translational movements.

In another embodiment, the roll restrainer 108 can be coupled with an agitating mechanism. When solid-ink pellets 101 are dropped onto the roll restrainer 108, the agitating mechanism may shake the roll restrainer 108 in the horizontal plane, avoiding any eventual uneven pile-up of the solid-ink pellets 101 on the roll restrainer 108. This embodiment, as described, would require additional electrically operated motors or mechanisms equipped with measures that assist in the agitating movements. This system may or may not include the spreader baffle 106.

Alternatively, an external agitator may also be provided to the roll restrainer 108. An agitating structure, for example a stirrer, provided from the top, may be applied to attain an evenly distributed solid-ink pellet surface on the roll restrainer 108.

On the surface of the roll restrainer 108 the solid-ink pellets 101 are melted. To this end, an electric heater 109 is provided to transmit heat energy to solid-ink pellets 101 lying on the restrainer surface, thereby causing the solid-ink pellets 101 to substantially melt. Accordingly, the roll restrainer 108 may be coupled to the heater 109 through electrical cables and may include a hot plate, a series of heating rods, or heating wires, allowing the heating and the subsequent melting operation to be carried out on its surface. Alternatively, the roll restrainer 108 can itself act as a heater through a direct electric connection.

In either case, the roll restrainer 108 must be made of a material that has excellent heat conductive properties, but should not cause a chemical reaction with the ink. Exemplary materials are aluminum or copper with an appropriate inert coating. Correspondingly, the electric heater 109 can be configured to attain a desired rate of melting of the solid-ink pellets 101. For example, based on the melting point of the solid-ink pellets 101, the temperature of the heater 109 may be regulated. In cases where the temperature requirements are limited, the roll restrainer 108 can be manufactured using materials like stainless steel. The maximum permissible temperature range for the roll restrainer 108 may be set between 90° C. to 120° C.

Further, the roll restrainer 108 being positioned in an inclined manner urges the liquidized ink to flow out into an adjacently positioned ink reservoir 110. The roll restrainer 108 alternatively can include drain holes at the bottom that may assist the melted ink to be drained down to the ink reservoir 110. In another embodiment, the melted ink can drain out of the roll restrainer 108 through the openings configured between the channels, grooves, spiked protrusions, or projections 304. Spout(s) can optionally be added at the end or at desired locations of the roll restrainer 108 to maintain smooth drainage of the melted ink into the ink reservoir 110. The permissible inclination angle for the roll restrainer 108 ranges between 10 to 20 degrees.

The roll restrainer 108 can also be adapted for a pivotal movement from a fixed fulcrum point. Upon the reception of the solid-ink pellets 101, the roll restrainer 108 may be maintained in a horizontal fashion. Subsequently, when heating and melting is performed, the roll restrainer 108 can be tilted in order to pour out the liquidized contents into the next station i.e., the ink reservoir 110.

Upon reception, the reservoir 110 stores the solid-ink in the liquid form for a very short period. Liquid ink extracted from here is transferred to the image forming/printing station/heads.

Figure 4:
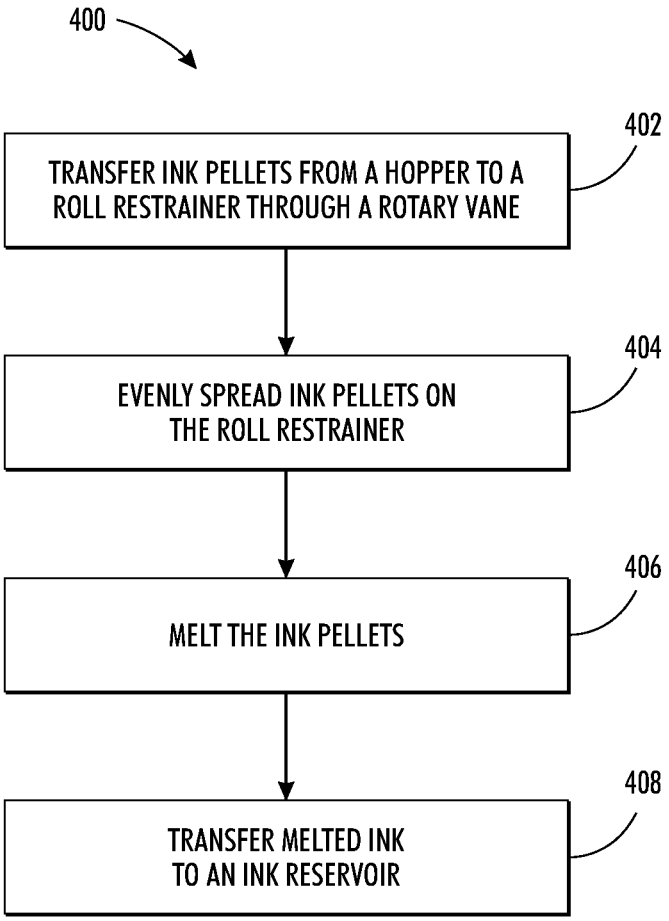
FIG. 4 is a flowchart illustrating an exemplary method for evenly distributing solid-ink pellets on a heating surface.

FIG. 4 an exemplary method 400 to deliver solid-ink through a controlled flow of solid-ink pellets 101 in an image forming apparatus in accordance with the present disclosure. The methodology presented here through a flowchart is identical to the methodology as discussed in connection with FIG. 1.

A solid-ink delivery system in an image forming apparatus includes a hopper 102 containing solid-ink pellets 101. Solid-ink pellets 101 are extracted and transferred from the storage medium and melted on the subsequent station and are further transferred to the image forming station via the reservoir 110.

At step 402, solid-ink pellets 101, stored in the hopper 102 are transferred through an exit vent 103. This transfer is carried out in a controlled fashion through a set of vanes 113 disposed on spindle 112 of a rotary vane 104. The shape of the hopper 102 is sloped downwards, enabling gravity to help in the transfer process. Accordingly, the hopper 102 is placed above the other components of the system.

At step 404, upon rotation of the rotary vane 104, solid-ink pellets 101 are uniformly dispensed through the vent 103 onto the roll restrainer 108. An even spread of the solid-ink pellets 101 on the roll restrainer 108 is enabled through a spreader baffle 106, disposed between the vent 103 and the roll restrainer 108, directing the solid-ink pellets 101 onto the roll restrainer 108 via grooves, apertures, or channels 202. Evenly spreading the solid-ink pellets 101 help achieve a uniform melt rate.

Upon dispensation from the hopper 102, the solid-ink pellets 101 are retained within the restrainer boundary, preventing them from rolling off the edges. To this end, the surface of the roll restrainer 108 includes multiple spreading members such as grooves, channels or projections 304, that are positioned equidistantly to each other. The distance between each consecutive spiked protrusions, grooves, or channels being limited to the size of the largest solid-ink pellet.

At step 406, the solid-ink pellets 101 are melted on the roll restrainer 108. This operation is made possible by having the roll restrainer 108 coupled to a heater 109 that enables the roll restrainer 108 to simultaneously function as a melting surface. Heating performed at this station subsequently melts the solid-ink pellets 101.

At step 408, the melted ink is delivered into an ink reservoir 110. This delivery is made possible through the incorporation of drain holes provided at the bottom of the roll restrainer 108.

Alternatively, an inclined position of the roll restrainer 108 can enable the placement of a spout at the extreme lower end of the roll restrainer 108 that can ease out the flow of the melted liquid. The melted ink being received in the ink reservoir 110 is passed onto the print heads to complete the image forming operation.

It will be apparent to those of skilled in the art that a number of structural variations can be introduced to enhance the operational efficiency of the components in relation to each other in a conventional ink delivery system. As defined, this system and its components are either universally suited for machines of different platforms or could it be individually developed for specific image forming apparatus.

It should be noted that the description does not set out specific details of the system, materials, design, or method of manufacture of the various components. Those skilled in the art are familiar with such details, and unless departures from those techniques are set out, techniques, designs, and materials known in the art should be employed. Those in the art are capable of choosing suitable manufacturing and design details.

The invention claimed is:

1. A system for delivering solid-ink pellets in an image forming device, the system comprising:

a hopper for retaining solid-ink pellets, the hopper having inwardly sloped sides defining a vent between their closest edges for passage of solid-ink pellets therefrom;

a rotary vane, disposed in the vent, including a spindle comprised of multiple vanes, space between adjacent vanes being sized to accept the solid-ink pellets;

a roll restrainer disposed beneath the hopper vent, having a first surface and a second surface, the first surface including spreading members, and the second surface heated to a temperature sufficient to melt the solid-ink pellets disposed on the first surface; and a spreader baffle slantingly disposed between the hopper vent and the roll restrainer, having a first edge and a second edge such that the first edge is fixed to one of the sloped sides of the hopper and the second edge is suspended above the roll restrainer.

2. The system of claim 1, wherein the rotary vane is coupled to an electric motor.

3. The system of claim 1, wherein the width of the second edge being substantially equal to the width of the roll restrainer.

4. The system of claim 1, wherein the spreading members are spaced apart by a gap substantially larger than the largest solid-ink pellet particle size of 1.2 mm.

5. The system of claim 4, wherein the spreading members include at least one or more of equidistant projections, apertures, or channels sized to accommodate the largest solid-ink pellets.

6. The system of claim 1, wherein the roll restrainer is coupled to a heater.

7. The system of claim 1 further comprising an ink reservoir, disposed adjacent the restrainer surface, for retaining ink melted on the restrainer surface.

* * * * *